US008007615B2

(12) United States Patent
Sadlier

(10) Patent No.: US 8,007,615 B2
(45) Date of Patent: Aug. 30, 2011

(54) METHOD OF MANUFACTURING VERSATILE FLEXIBLE COVER

(75) Inventor: Claus E. Sadlier, Woodside, CA (US)

(73) Assignee: Covermate, Inc, Hayward, CA (US)

( * ) Notice: Subject to any disclaimer, the term of this patent is extended or adjusted under 35 U.S.C. 154(b) by 0 days.

(21) Appl. No.: 12/847,730

(22) Filed: Jul. 30, 2010

(65) Prior Publication Data

US 2010/0319840 A1 Dec. 23, 2010

Related U.S. Application Data

(62) Division of application No. 11/840,019, filed on Aug. 16, 2007.

(51) Int. Cl.
*B31F 1/00* (2006.01)

(52) U.S. Cl. ..... 156/211; 156/160; 156/70

(58) Field of Classification Search ..... 156/73.1, 156/218, 211, 160, 70, 163, 229; 150/157
See application file for complete search history.

(56) References Cited

U.S. PATENT DOCUMENTS

| | | | | |
|---|---|---|---|---|
| 409,354 | A | | 8/1889 | Green |
| 1,997,738 | A | | 4/1935 | Maxedon et al. |
| 2,064,411 | A | | 12/1936 | Brandstein |
| 2,082,108 | A | | 5/1937 | Brandstein |
| 2,478,121 | A | | 3/1945 | Morner |
| 2,466,643 | A | | 4/1949 | Magid |
| 2,484,340 | A | | 10/1949 | Gardner |
| 2,490,451 | A | | 12/1949 | Magid |
| 2,580,075 | A | | 12/1951 | Clark et al. |
| 2,768,107 | A | | 10/1956 | Magid |
| 2,903,034 | A | | 9/1959 | Vrana |
| 3,035,960 | A | | 5/1962 | Farkas et al. |
| 3,246,446 | A | | 4/1966 | Powers |
| 3,403,409 | A | | 10/1968 | Wagenfeld |
| 3,505,149 | A | * | 4/1970 | Sanchez ..... 156/383 |
| 3,560,292 | A | | 2/1971 | Butter |
| 4,132,156 | A | | 1/1979 | Glaze, Jr. |
| 4,509,570 | A | | 4/1985 | Eby et al. |
| 4,560,434 | A | | 12/1985 | Sato |
| 4,690,248 | A | | 9/1987 | Killeen |
| 4,691,390 | A | | 9/1987 | McKeown |
| 4,765,854 | A | | 8/1988 | McKeown |
| 4,797,523 | A | | 1/1989 | Kohnen |

(Continued)

FOREIGN PATENT DOCUMENTS

| | | |
|---|---|---|
| WO | WO 0039005 A1 | 7/2000 |

(Continued)

*Primary Examiner* — Philip Tucker
*Assistant Examiner* — Vishal I Patel
(74) *Attorney, Agent, or Firm* — David Pressman

(57) ABSTRACT

A flexible cover is formed from a rectangular sheet of plastic film material and a continuous elastic or rubber band. The sheet has a predetermined amount of material cut from each corner. The sheet is placed onto a table between four posts that extend from the table. The sheet is positioned so that a post lines up with each corner of the sheet. A rubber band is stretched across the four posts into a similar shaped rectangle and rests just above side edges of the sheet. The side edges of the sheet are folded inward and over the stretched band and heat sealed directly to the sheet. The band is now sealed within a pocket formed along the sides of the sheet. Each corner of the stretched band is released from its post, allowing the band to relax and pull the formed pockets toward the center.

15 Claims, 7 Drawing Sheets

U.S. PATENT DOCUMENTS

| | | | | |
|---|---|---|---|---|
| 4,844,248 | A | 7/1989 | Forberg et al. | |
| 4,938,607 | A * | 7/1990 | Kelley | 383/4 |
| 5,325,986 | A | 7/1994 | Richardson et al. | |
| 5,624,729 | A | 4/1997 | Cohen et al. | |
| 5,690,248 | A | 11/1997 | Hulls | |
| 6,276,551 | B1 | 8/2001 | Miller, II | |
| 6,351,852 | B1 * | 3/2002 | Propp | 2/174 |
| 6,820,283 | B2 | 11/2004 | Graneto, III | |
| 6,887,061 | B2 | 5/2005 | Donovan et al. | |
| 6,994,469 | B2 | 2/2006 | Sleight et al. | |
| 7,011,228 | B2 | 3/2006 | Ordiway | |
| 7,051,895 | B2 | 5/2006 | Toussant et al. | |
| 2004/0086205 | A1 | 5/2004 | Raterman | |
| 2004/0099666 | A1 * | 5/2004 | Ordiway | 220/287 |
| 2004/0251256 | A1 | 12/2004 | Turvey et al. | |
| 2007/0036472 | A1 | 2/2007 | Persenda | |

FOREIGN PATENT DOCUMENTS

| | | | |
|---|---|---|---|
| WO | WO 03106281 | A1 | 12/2003 |
| WO | WO 2005115860 | A1 | 12/2005 |

* cited by examiner

METHOD OF MANUFACTURING VERSATILE FLEXIBLE COVER

CROSS-REFERENCE TO RELATED APPLICATION

This is a divisional of Application Ser. No. 11/840,019, Filed Aug. 16, 2007, now

BACKGROUND

Prior Art

There are primarily three types of container or plate covering systems of which I am aware.

The first is a fixed-size container lid which is sized and manufactured to fit a specific container. For example plastic food storage containers such as those sold under the trademark Tupperware are generally sold with matching plastic lids. This approach requires that a specific matching lid be available to cover the container. The lid cannot be used on a different size or shape container.

The second type of system for covering plates as well containers is flexible plastic film and foil generally provided in a continuous sheet on a roll, such as rolls of plastic wrap sold under the trademark Saran or foil sold under the trademark Reynolds. In order to cover a bowl or plate the user simply cuts a length of the film or foil and manually molds the cut film or foil over the container. Although this system is flexible enough to cover containers of various sizes and shapes, it is often difficult to cut the film to the correct length and apply to a container without the film sticking to itself or its edges lifting from the container. Additionally it is difficult to re-cover a container with the same piece of film since plastic films loose their ability to stick to the container after prolonged use and aluminum foils tear and become wrinkled. Also, foil is not transparent, and as such does not allow someone to see what is being stored in the container. And because it is metallic it can not be used in some microwave ovens.

The third type of plate and container covering system is a flexible film cover with an elastic band sewn along the edge. S C Johnson Co. sells this product under their trademark Quick Covers. This type of cover was originally developed and used as a shower cap and has been commercially available for many years. This "shower cap" type cover is made from a circular sheet of plastic film with a strip of elastic sewn directly around the perimeter. There are four major drawbacks to this design. The first is that it is unsanitary and unsightly for use with food items due to the fact that the elastic band is sewn into the plastic so that the thread and the ends of the elastic are not contained within and often hang from the cover. When the thread gets wet it could promote the growth of bacteria and produce a food safety issue. The second drawback of these covers is that the exposed elastic band emits an undesirable rubbery smell. The third drawback is that these covers cannot be mass produced on high speed machinery. The forth drawback is that these covers do not fit both elliptical and rectangular containers with similar size openings and therefore have relatively low versatility.

U.S. Pat. Nos. 2,466,642 and 2,490,451 to Magid (1949) disclose a method of making a cover whereby an elastic band is heat sealed into a hem along the periphery of circular sheet of plastic film. Although this design eliminates the unsanitary and undesirable smell and aesthetics of the traditional shower-cap type cover, these do not fit both elliptical and rectangular containers with similar size openings and therefore are not as versatile. In addition the process produces a cover whereby the sealed edge faces the outside of the cover (as shown in FIG. 4 of the '451 patent). This makes the product look less finished and not esthetically pleasing. As a result these covers have never achieved commercial success, insofar as I am aware.

International publication number WO 2005/115,860 A1 (2005) to B-New International AB discloses a cover made from an octagonal sheet with an elastic band heat sealed into a hem along each of the eight sides. There are a number of deficiencies with this cover. As with previously mentioned covers, these covers do not fit both elliptical and rectangular containers with similar size openings and therefore are not as versatile. Secondly, in order to manufacture this cover, eight holes or wedge shaped openings must be formed into the cover. This quantity of holes or openings makes the product look defective, less finished and not esthetically pleasing. In addition it allows the elastic band to be exposed to the air which can increase the amount of odor being emitted from the rubber. Third, the fact that the cover has eight sides which must be folded and sealed, combined with the tight tolerance and acute angle between each pair of adjacent sides, make it difficult to manufacture.

ADVANTAGES

Accordingly, some advantages of one or more aspects are to provide an improved cover that a) can fit containers and plates a variety of shapes, b) has a cinching band that is more sanitary and esthetically pleasing, c) is made with a more aesthetically pleasing seam, d) can be made without having to form eight holes around the edge of the cover, and e) can fit a wider variety of sizes of containers, Other advantages are to provide a cover that e) can be printed, f) can be used to reheat food in a microwave oven, g) can be easily manufactured, in one or more aspects h) can have perforations to allow steam to escape when used for re-heating food in a microwave oven. Further advantages of one or more aspects will become apparent from the ensuing description and accompanying drawings.

SUMMARY

In accordance with one embodiment, a more versatile flexible cover is formed from a rectangular sheet of plastic film material and a continuous elastic or rubber band. The sheet preferably has a predetermined amount of material cut from each corner. The sheet is placed onto a table between four posts that extend from the table. The sheet is positioned so that a post lines up with each corner of the sheet. A rubber or elastic band is stretched across the four posts into a square and rests just above the sheet. The stretched band now has four sides which correspond to the four sides of the sheet. Next, each of the side edges of the sheet are folded inward and over the stretched band and heat sealed directly to the sheet. The band is now sealed within a pocket that is formed around the edges of the sheet. Each corner of the stretched band is then released from its post, which causes the band to relax and pull the four corners of the sheet toward the center. This creates a balloon or generally spherical shaped cover which can be used on covers of a variety of shapes, including rectangular and circular openings of similar sizes.

DRAWING FIGURES

DRAWING--REFERENCE NUMERALS

| | |
|---|---|
| 10 film sheet | 10C diagonal and straight corner cut. |
| 10C' plain diagonal corner cut | 10C" curved corner cut |
| 10I inside surface of film sheet | 10LS long side |
| 10S side. | 10SS short side |
| 10UF unfolded flap | 10FF folded flap. |
| 10FE folded edge | 11R elastic band in relaxed state. |
| 11S elastic band in a stretched state | 12 corner post. |
| 13 seam | 13H heat seal area. |
| 13P pocket | 14 corner. |
| 15 cover | 15O cover opening. |
| 15B cover body | 16 printed corner mark. |
| 17 perforations | 18R round container. |
| 18S square container. | |

DETAILED DESCRIPTION AND OPERATION

First Embodiment

Figure 1A:
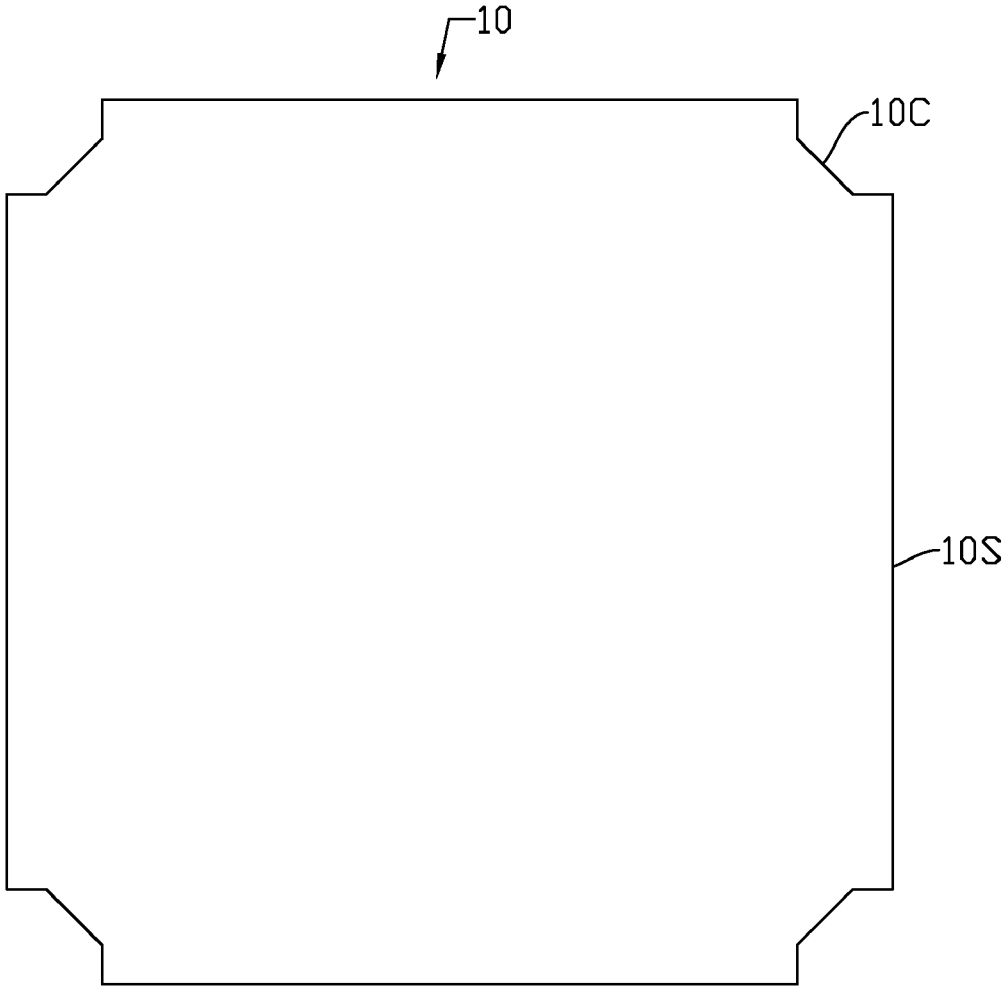
FIG. 1A is a plan view of a film sheet used to make a more versatile flexible container cover.

FIG. 1A shows a plan view of a thin plastic sheet 10 of film material that is used to make the flexible cover of FIG. 6. Sheet 10 is cut from a larger roll of material (not shown), the methods of which are well known in the industry. The sheet is rectangular in shape in its free, unfolded and ungathered state and has four sides 10S, where each pair of adjacent sides are 90 degrees apart. A cut 10C is made at each corner to remove a predetermined amount of material from each corner for reasons discussed below. Such corner cuts preferably are done when the sheet is cut from the roll. Each cut has a diagonal center portion and two outer portions, each of which is perpendicular to the respective adjacent side 10S. The sheet preferably is made from any thin plastic film material such as polyethylene, polypropylene, nylon, polyethylene terephthalate (PET) or any combination of these and other materials. All of these materials can be used in a microwave oven. Additionally a biodegradable film can be used, such as polylactic acid (PLA) or polyvinyl alcohol (PVA) which contains starch in order to be biodegradable. For this first embodiment low density polyethylene (LDPE) preferably is used due to its ability to stretch, its lack of stiffness and its clarity. The thickness of the material can be in a range of between 0.01 mm to 0.076 mm (0.0004 to 0.003 inch). In this first embodiment a square LDPE sheet that is 36 centimeters by 36 centimeters (14 inches by 14 inches) with a thickness of 0.025 mm (0.001 inch) is used.

Figure 1B:
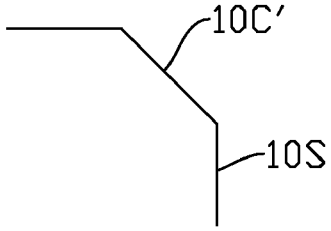
FIG. 1B is a partial plan view of an alternative corner cut configuration.
Figure 1C:
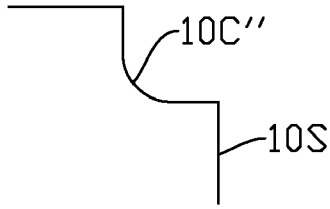
FIG. 1C is a partial plan view of another alternative corner cut configuration.
Figure 9:
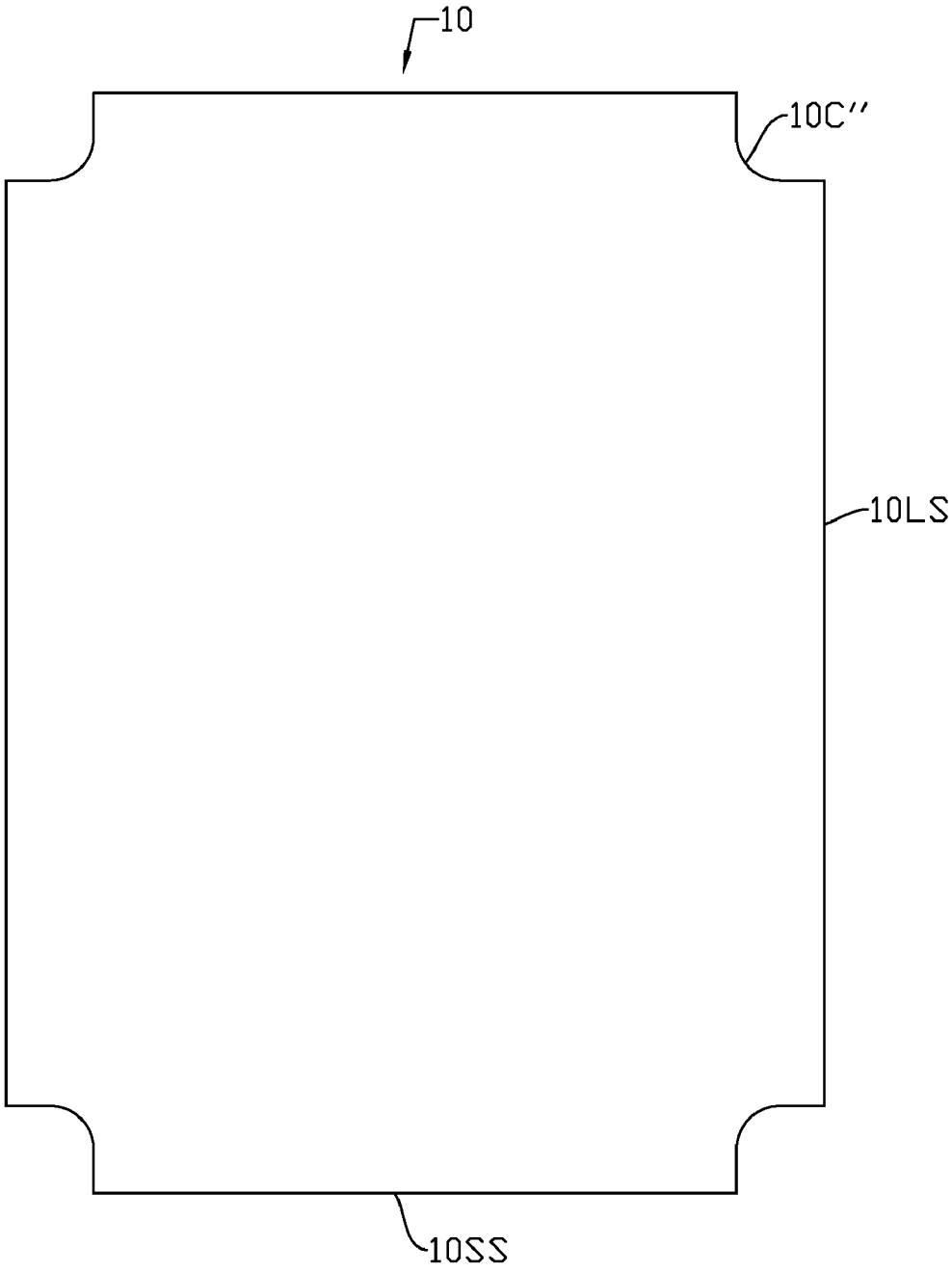
FIG. 9 is a plan view of a film sheet similar to that of FIG. 1 but with an oblong rectangular shape.

In the embodiment of FIG. 9, the sheet has an oblong rectangular configuration with two short opposite parallel sides 10SS and two long parallel opposite sides 10LL and with curved cut corners 10C" similar to that of FIG. 1C.

Figure 3:
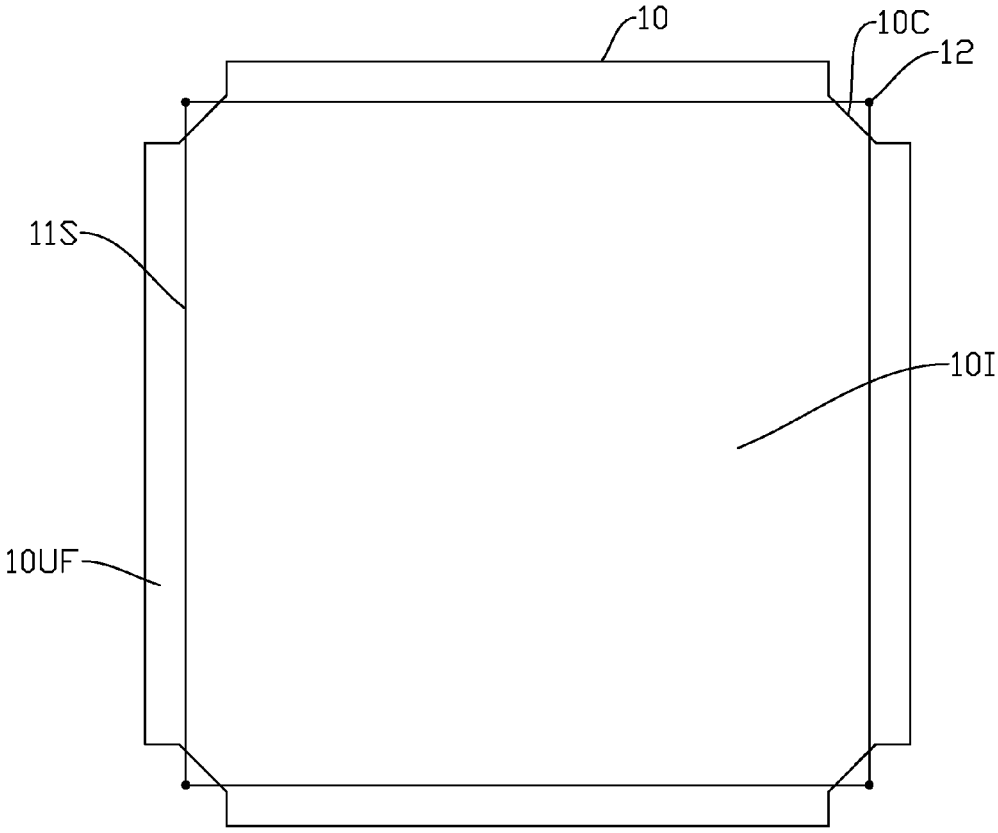
FIG. 3 is a plan view of the sheet with the elastic band stretched around four corner posts and resting above the sheet.

In lieu of the diagonal and rectangular corner cuts of FIG. 1A, each corner cut 10C can have any other shape and size so long as it allows room for a post to hold the rubber band above sheet 10 as shown in FIG. 3. For example a plain diagonal cut 10C' may be made as shown in FIG. 1B or a curved cut 10C" may be made as shown in FIG. 1C.

Figure 2:
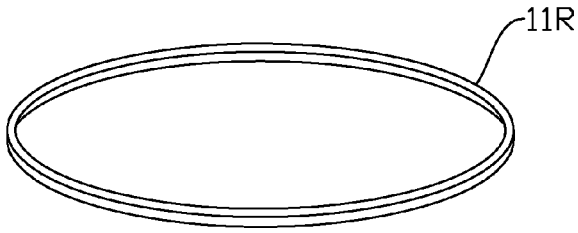
FIG. 2 is a perspective view of a relaxed elastic band used to make the cover.

FIG. 2 shows of perspective view of an endless elastic band or loop 11R in a relaxed and unstretched state that is used to make the flexible cover. The elastic band preferably is made from any thin elastic material such as latex (natural rubber), or latex-free material, such as polyisoprene, polyurethane, or a combination of these and other materials, in any color available. It has an unstretched or free length around its perimeter that is less than 50% of the length of the perimeter or periphery of the plastic sheet for reasons to be discussed below. All of these materials can be used in a microwave oven. For this first embodiment a white elastic band made from polyisoprene is used because it is a synthetic latex free material with good stretch characteristics. The cross sectional dimension of the rubber band can have a width and a thickness in the range of between 0.127 mm to 6.35 mm (0.005 to 0.250 of an inch). For this first embodiment a polyisoprene band having a free or unstretched length around its perimeter of 30.5 centimeters (12 inches) with a square cross section (equal width and thickness) of approximately 1.5 mm (0.060 inch) is used.

FIG. 3 shows a plan view of sheet 10 lying flat on a table (not shown) with an inside surface 10I facing up, and with elastic band stretched 11S over the top of the sheet 10 and held in place by being secured around four corner holding posts 12 that project up from the table and are aligned with each corner of the sheet. Each corner cut 10C allows room for the post to hold the elastic band above the sheet without interfering with the folding process discussed below. A marginal area of each side of sheet 10 extends outside of stretched band 11S to form four elongated unfolded flaps such as 10UF.

Figure 4A:
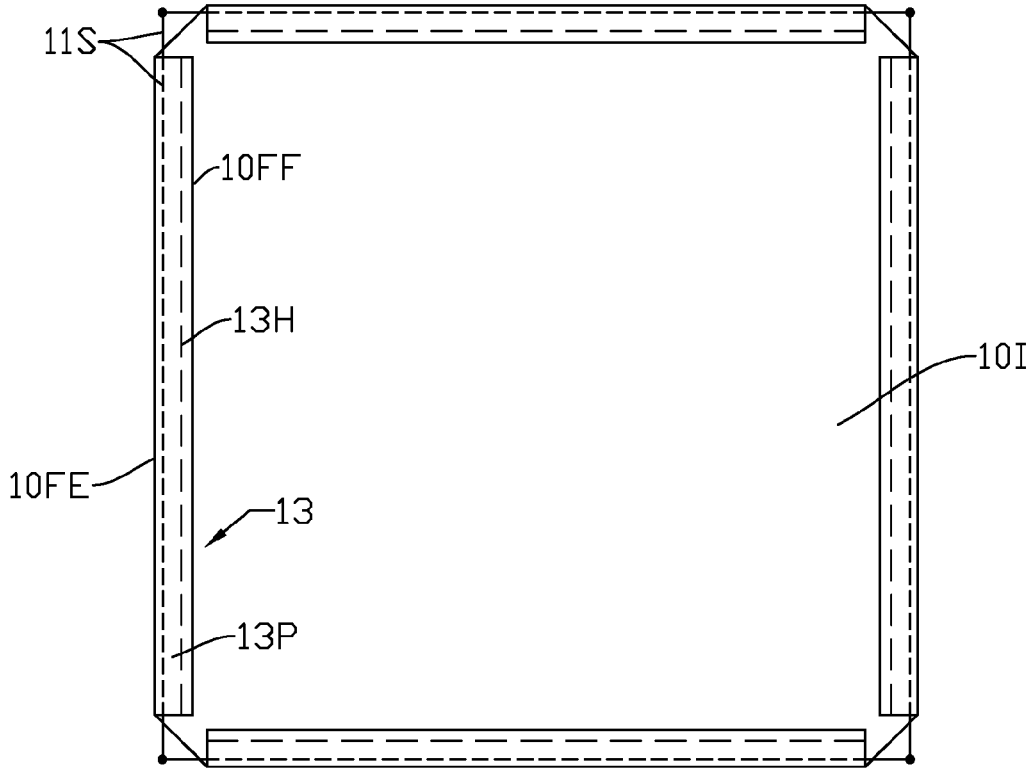
FIG. 4A is a plan view of the sheet with each of the side edges folded over the elastic band and sealed to the sheet.
Figure 4B:
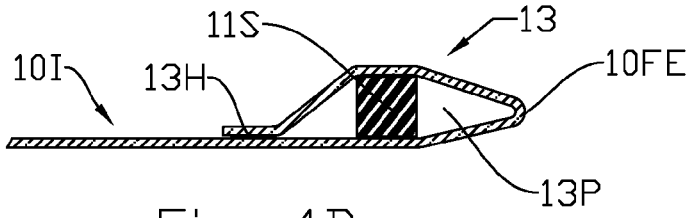
FIG. 4B is a partial side-sectional view of the folded and sealed edge forming a pocket which contains the elastic band.

FIG. 4A shows a plan view of the four flaps 10UF folded over the elastic band to become folded flaps 10FF that are heat sealed to the sheet along a sealing area 13H to form a seam 13. The process of heat sealing the plastic sheet to itself is well known in the art. This can also be seen in the partial side sectional view of FIG. 4B. Seam 13 is on the inside or upper surface 101 of the sheet which will form the inside surface of the cover. An elongated pocket or sleeve 13P (FIG. 4B) is formed at the seam between folded edge 10FE and sealing area 13H within which elastic band 11S is contained. In order for sheet 10 to pleat and allow the elastic band to relax to form the cover, as will be shown later, the cross-sectional area of pocket 13P as shown in FIG. 4B should be at least 1.5 times as large as the cross sectional area of the elastic band in its stretched state. If the pocket is less than about 1.5 times the cross section area of the elastic band the sheet tends to bind up on the elastic band, restricting its ability to relax as will be detailed below.

Figure 5:
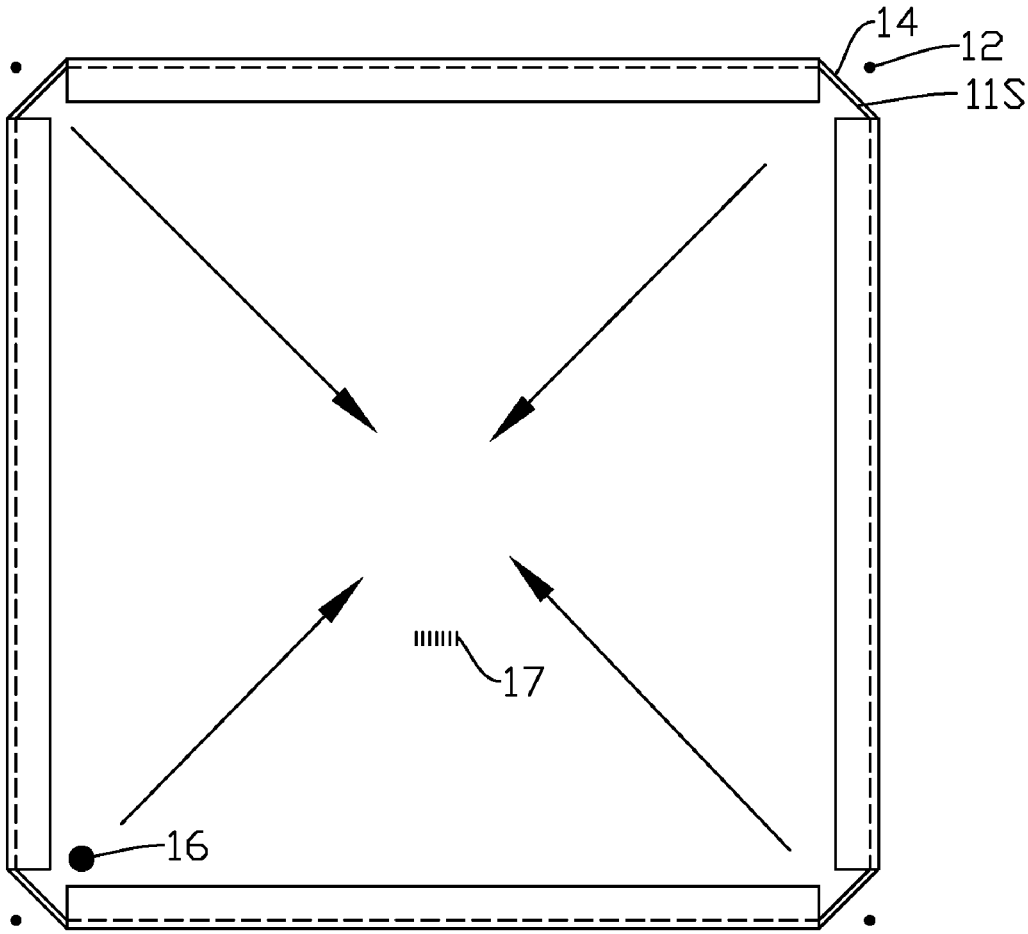
FIG. 5 is a plan view showing the elastic band being released from the corner posts with arrows indicating the direction that the corners will be drawn in as the elastic band is relaxed.

FIG. 5 shows a plan view of the elastic band 11S after release from the corner posts 12 and before band 11S contracts. FIG. 5 also shows an optional dot 16 that can be imprinted near one corner of sheet 10. Dot 16 makes it even easier for a user to identify the corners of the cover so that the corners of the cover can be aligned with the corners of a rectangular container. Any other suitable corner identifier can be used. Such marking preferably is done prior to cutting the sheet from the starting roll or, while the sheet is positioned on the table. For applications where the cover is used over food that is heated in a microwave, a hole or holes, perforations, micro perforations, or slits 17 can optionally be formed into the cover to allow steam to vent or escape more quickly from the cover as the food is being heated. Micro perforations are holes with a diameter of less than 0.5 mm (0.02 inch); these are small enough to prevent contaminates from entering the cover, but will allow steam to escape.

Figure 6A:
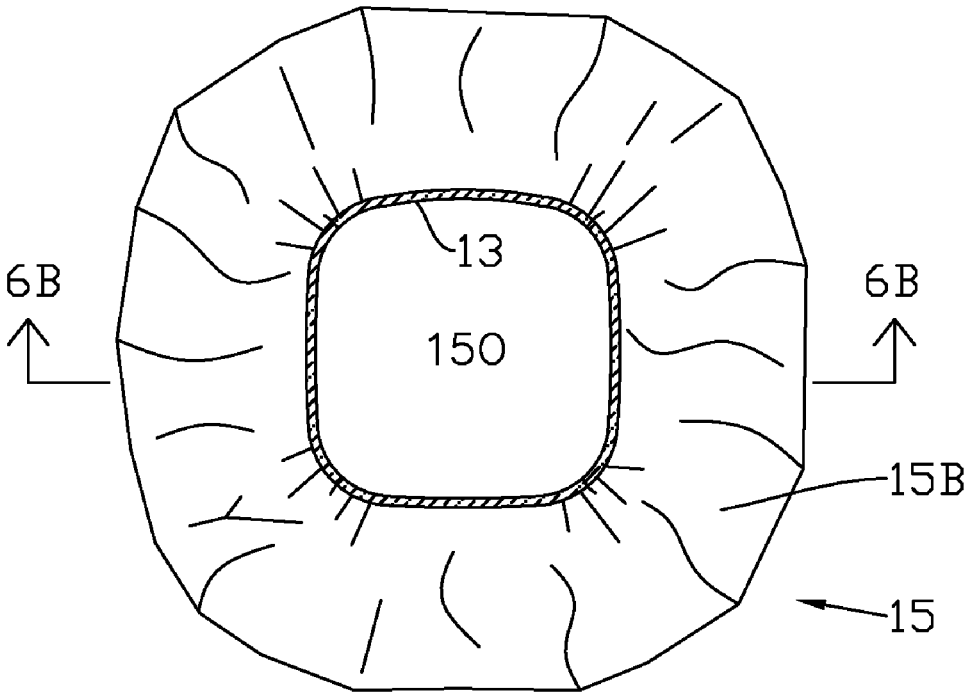
FIG. 6A is a plan view showing the cover with the elastic opening at the top.
Figure 6B:
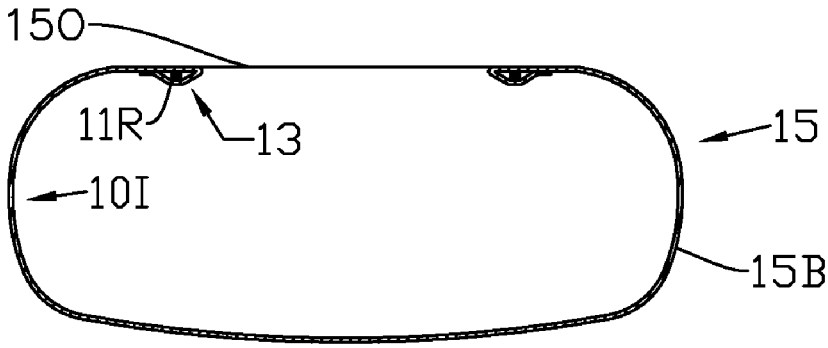
FIG. 6B is a side section view of the cover of FIG. 6A taken along the line 6B—6B of FIG. 6A showing the sealed edges facing the inside.

Once released, the stretched elastic band will contract as shown by the arrows in FIG. 5 to a relaxed state which will have the effect of pulling each corner 14 inward and toward the center of the sheet. This action will roll or gather the edge portions of sheet 10 inward and place seam 13 on the inside of cover 15 as shown in FIGS. 6A and 6B. FIG. 6A is a view of cover 15 with the opening 150 at the center and facing up. Opening 150 is bordered by seam 13, which is generally rectangular.

Although the initial starting sheet is rectangular, cover 15 unexpectedly becomes substantially circular when the elastic is allowed to relax by pulling each corner to the center as shown in FIGS. 6A and 6B. Opening 150 has a near rectangular shape in its relaxed state (FIG. 6A) because more pleats form in the corners due to the excess of material that gathers at each corner as shown. By near rectangular shape I mean that the shape appears to have four corners. The near rectangular shape of the opening is beneficial because it allows the user to identify the corners of the cover before placing it on a rectangular container. However, the rest of body 15B of the cover is generally circular in shape as if the starting sheet had been cut as a circle rather than a rectangle. The use of a rectangular starting blank thus makes the cover easier to fabricate because the corners can be more easily identified and aligned with holding posts 12 and provides flaps 10UF which can easily be folded over the elastic band.

Figure 7:
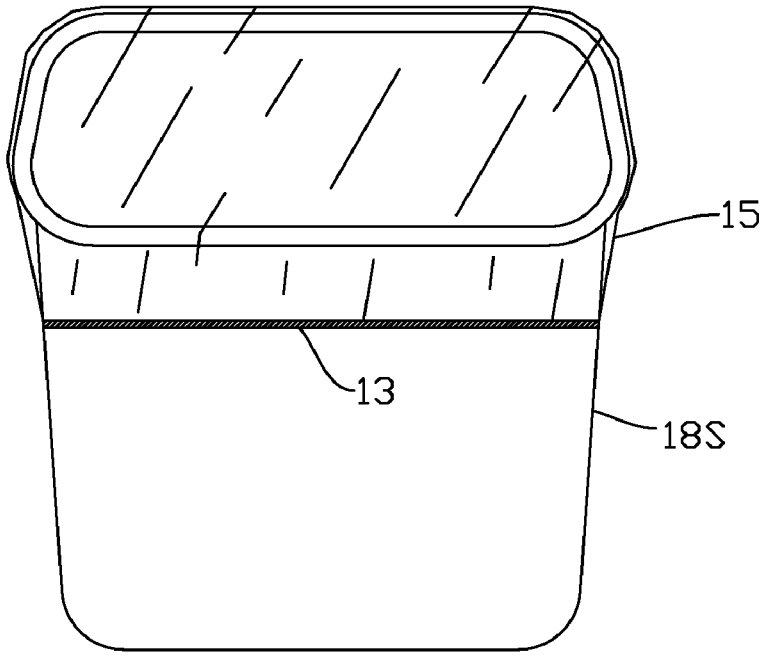
FIG. 7 is a perspective view of the cover covering a round container.
Figure 8:
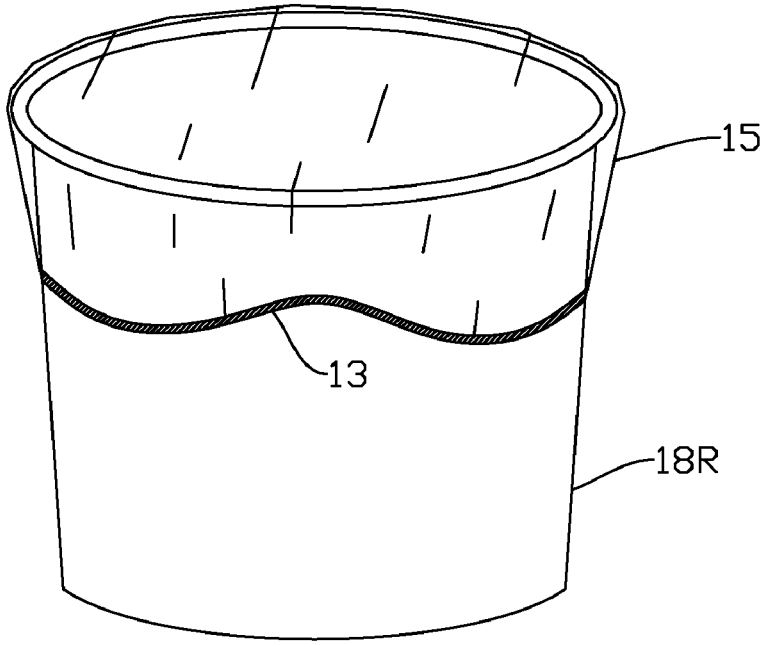
FIG. 8 is a perspective view of the cover covering a rectangular container.

To use cover 15, opening 150 is simply stretched and the cover is placed over a plate (not shown) or a container 18S (FIG. 7) or 18R (FIG. 8) and released. This allows the elastic band to relax and contract, pulling the sheet tightly over the mouth of the container. Because of the rectangular shape of the starting sheet, the cover can be placed on both round containers 18R and square containers 18S with similar size openings. For example a cover that is sized to fit a 25.4-cm (10-inch) diameter circular plate will also fit a 25.4 cm (10-inch) wide square food storage container. When the cover is placed over a rectangular container, the excess material in each corner is utilized to allow the cover to stretch over the corners of the container. When the same cover is placed over a circular container this excess material remains pleated or bunched in the cover, or the elastic can be pulled down the container further to stretch the excess material. This functionality is illustrated in FIGS. 7 and 8.

CONCLUSION, RAMIFICATIONS, SCOPE

The reader will see that according to the disclosure, I have provided a cover that, in various aspects, has one or more of the following features: it can easily fit both circular and rectangular plates and containers, it is sanitary and esthetically pleasing, it is microwavable, and it can be easily manufactured.

While the above description contains many specificities, these should not be construed as limitations on the scope of the invention, but as exemplifications of the presently preferred embodiments thereof. Many other ramifications and variations are possible within the teachings of the disclosure.

For example covers to fit larger size containers and plates can be made by using a larger size sheet and/or elastic band. Likewise covers designed to fit smaller plates and containers can be made by using a smaller size sheet and/or elastic band. The shape of the rectangular sheet can have equal length sides to form a square, or can have two sides that are longer than the other two. It can be translucent or opaque, as well as transparent. The cutoff corners on the sheet can be omitted, in which case the corners can be folded inwardly to avoid the posts, whereafter the flaps and parts of the folded corners can be folded and sealed over the elastic band. Also cutoff corners on the sheet can be omitted and the posts can be made short and pointed so as to pierce the corner portions, whereafter the corners as well as the flaps and can be folded and sealed over the elastic band. The cover can be used to cover trays, beverage containers, laboratory containers, etc., as well a plates and food containers.

For higher heat applications polypropylene, nylon, or polyethylene terephthalate (PET) can be used in lieu of polyethylene. Cast polypropylene for example is similar to polyethylene in is formability and clarity, but has a melt point that is approximately 100 degrees higher. Nylon and PET are both used as materials for ovenable turkey bags and would provide a cover with an even higher operating temperature than polypropylene. For a biodegradable cover a biodegradable film such as polycarprolactone (PCL), polyvinyl alcohol (PVA) and polylactic acid (PVA) can be used. These polymers contain starch in order to biodegrade.

Different materials and different colors can be used for the elastic or rubber band. For example a different color rubber band can be used to identify different size covers. And clear polyurethane bands can be used in lieu of colored rubber bands. The cross-section of the band can be rectangular, oval, triangular, or circular, etc.

While certain representative embodiments and details have been shown for purposes of illustrating the disclosure, it will be apparent to those skilled in the art that various changes in the methods and apparatus disclosed may be made without departing from the scope of the disclosure, which is defined in the appended claims and their legal equivalents.

I claim:

1. A method for manufacturing a flexible container cover, comprising:

a) providing a flat sheet of flexible film material having a generally rectangular shape with four sides and four recessed cut corners, each pair of adjacent cut corners forming a flap along a side of said sheet between said pair of cut corners, b) providing an elastic band, c) providing a surface having a set of four posts extending therefrom and arranged to define the corners of a generally rectangular shape similar to the shape of said sheet, d) laying said sheet onto said surface between said posts so that said posts are respectively aligned with and positioned within said four recessed cut corners, e) stretching said elastic band around said posts so that said posts hold said stretched elastic band in a generally rectangular shaped configuration above said sheet so that said band has four straight segments, each of said segments running parallel to a respective one of said four sides of said sheet and positioned a predetermined distance inward of the edge of said respective side so that each of said four flaps extends a predetermined distance beyond its respective segment of said stretched elastic band f) utilizing said stretched elastic band as a fulcrum and folding each of said flaps inward and over said elastic band, g) sealing a portion of each of said flaps to respective portion of said sheet to form four pockets or sleeves which enclose said four segments of said elastic band, respectively, and h) removing said elastic band from said posts so that said stretched elastic band can contract within said pockets and gather said four sides of said sheet to form a cover having a stretchable opening.

2. The method of claim 1 wherein said elastic band is endless.

3. The method of claim 1 wherein said flexible film material is biodegradable.

4. The method of claim 1 wherein said sealing is accomplished by the application of heat and pressure.

5. A method for manufacturing a flexible container cover, comprising:

a) providing a sheet of flexible material having a generally rectangular shape with four sides which define the area of said sheet, said sheet having four recessed cut corners forming an elongated flap along each of said sides, b) providing a means for holding a stretched elastic band around said sheet so that said stretched elastic band has four straight segments which are parallel to said respective four sides of said sheet and which define a planar boundary with an area which is less than said area of said sheet, each of said flaps extending beyond its respective side of said elastic band, c) using said four segments of said stretched elastic band as a fulcrum, folding said flaps of said sheet inward and over said respective segments of said stretched elastic band, d) sealing said flaps to respective portions of said sheet to the inside of said boundary to form four respective pockets or sleeves which enclose said respective segments of said elastic band, and e) removing said elastic band from said holding means so that said elastic band can contract within said pockets and gather said sheet to form a cover having a stretchable opening.

6. The method of claim 5 wherein said means for holding comprises a surface having posts extending up therefrom.

7. The method of claim 5 wherein said elastic band is endless.

8. The method of claim 5 wherein said sealing is accomplished by the application of heat and pressure.

9. The method of claim 5 wherein said sheet of flexible material is made from film material that is biodegradable.

10. A method for manufacturing a flexible container cover, comprising:

providing a sheet of film material having a generally rectangular shape with four sides which define the area of said sheet, said sheet having four recessed cut corners and a flap along each of said sides, providing a means for holding a stretched elastic band in a generally rectangular shaped configuration around said sheet so that said band has four straight segments, each of said segments running parallel to one of said sides and positioned a predetermined distance inward of the edge of said sides so that each of said flaps extends beyond a respective segment of said elastic band, using each of said elastic band straight segments as a fulcrum and folding each of said flaps around its respective segment and sealing a portion of said flaps to said sheet to form a hem which encloses said elastic band, and removing said cover from said holding means so that said elastic band can contract within said pockets and gather said sheet to form a cover having a stretchable opening.

11. The method of claim 10 wherein said elastic band is endless.

12. The method of claim 11 wherein said elastic band is seamless.

13. The method of claim 10 wherein said sealing is accomplished by the application of heat and pressure.

14. The method of claim 10 wherein said sheet of film material is made from a material that is biodegradable.

15. The cover of claim 10 wherein said sheet of film material and said elastic band are made from microwave safe materials so that said cover is microwave safe.

* * * * *